United States Patent [19]

Alvis et al.

[11] 4,030,557

[45] June 21, 1977

[54] WELL DRILLING APPARATUS AND METHOD

[75] Inventors: Robert L. Alvis; Melvin M. Newsom, both of Albuquerque, N. Mex.

[73] Assignee: The United States of America as represented by the United States Energy Research and Development Administration, Washington, D.C.

[22] Filed: May 3, 1976

[21] Appl. No.: 682,806

[52] U.S. Cl. ..... 175/4.5; 175/4.55

[51] Int. Cl.[2] ..... E21B 7/00

[58] Field of Search ..... 175/2, 3.5, 4.5, 4.56, 175/4.57, 4.6, 4.55

[56] References Cited

UNITED STATES PATENTS

| | | | |
|---|---|---|---|
| 2,544,573 | 3/1951 | Vincent | 175/4.5 |
| 3,070,010 | 12/1962 | Robinson, Jr. | 175/4.5 |
| 3,083,778 | 4/1963 | Friedman et al. | 175/4.5 |
| 3,130,797 | 4/1964 | Johnson | 175/4.5 |
| 3,491,841 | 1/1970 | Robinson | 175/4.5 |
| 3,670,828 | 6/1972 | Bennett | 175/4.5 |

OTHER PUBLICATIONS

*Drilling DCW* July 1975 pp. 52 to 54.

*Primary Examiner*—Ernest R. Purser
*Assistant Examiner*—Richard E. Favreau
*Attorney, Agent, or Firm*—Dean E. Carlson; Dudley W. King; Robert W. Weig

[57] ABSTRACT

Well drilling rates may be increased by impelling projectiles to fracture rock formations and drilling with rock drill bits through the projectile fractured rock.

6 Claims, 14 Drawing Figures

100
31
112
134
136
102
140
148
147
146
145
142
143
144
113
110
154
104
118
122
102'
106
108
120
103
152
116
60
140'

WELL DRILLING APPARATUS AND METHOD

FIELD OF THE INVENTION

The invention relates to improving well drilling rates by using projectiles to fracture rock and drilling through the projectile fractured rock.

BACKGROUND OF THE INVENTION

Rotary drilling rock bits are commonly used to drill boreholes for oil wells, gas wells, geothermal wells, etc., especially where the terrain consists of soft to medium hard rock. Rotary drilling rock bits drill by essentially appplying point loads to the rock with a series of hardened knobs, cutters, protrusions or projections on rotatably mounted conical surfaces. The point loads are of sufficient magnitude to comminute the rock by fracturing, shearing and the like.

In deep drilling, such as to depths greater than about 5,000 feet, high strength igneous rock is frequently encountered. Such rock may effectively reduce or altogether stop the drilling because it has a higher hardness than most other commonly encountered rock formations. When the drill bit's cutting surfaces rapidly wear and its penetration rate decreases from increased rock hardness, the drill must be pulled from the hole to change to bits which provide harder cutting surfaces, such as tungsten carbide or possibly diamond bits. Such required bit changes cause an appreciable amount of down-time and hence economic loss to drilling investors.

Future exploration and development of the energy and mineral resources in the United States and throughout the world will require a great amount of drilling. Much of this drilling will be at great depths and through formations of extremely hard rock. While state of the art drilling technology has been primarily confined to softer oil and gas bearing sedimentary formations, the cost of drilling even this relatively soft rock is expensive. Much future drilling, particularly geothermal drilling, will be in formations having very hard rocks. Therefore, future drilling using state of the art drills will be very time consuming and expensive because of the greater depth to be achieved and the harder rock to be encountered.

SUMMARY OF THE INVENTION

In accordance with the present invention, there is provided an apparatus and method for drilling through igneous rock and other hard materials. Penetrating or fracturing projectiles or shaped charges are impelled into the rock immediately below a conventional drill bit at various locations on the rock to be drilled relative to the path of the drill bit to fracture the rock and thereby render a drillable by conventional bit. Projectiles may be impelled one at a time, sequenced in any desired manner; they may be fired in several ways and may be of any selected type, two projectile embodiments being disclosed by way of example.

One object of the present invention is to decrease hard rock drilling costs.

Another object of the invention is to increase rock drilling rates.

Still another object of the instant invention is to fracture hard rock below conventional drill bits to reduce bit wear.

One advantage of the present invention is that in accordance therewith, down-time during drilling operations is substantially reduced.

Another advantage in practicing the present invention is that drill bit life is lengthened.

Still another advantage of the present invention is that the need for expensive diamond bits when drilling through hard rock is lessened.

BRIEF DESCRIPTION OF THE DRAWINGS

Other objects and advantages of the present invention will be apparent to those skilled in the art from the following description with reference to the appended drawings, wherein like numbers denote like parts, and wherein.

DETAILED DESCRIPTION OF A PREFERRED EMBODIMENT OF THE INVENTION

Drilling at accelerated rates through hard formations such as igneous rock formations is accomplished in accordance with the invention by impelling shaped charges, penetrators, projectiles or the like to fracture, shear, break and/or penetrate a rock formation followed by drilling with a rock drill through the fractured formation until the drill bit has penetrated a predetermined distance, or until the drill is not advancing satisfactorily. At such time additional projectiles are used to gain fracture the rock below the drill bit. These steps may be repeated as desired to accomplish rock or other fracturable hard formation drilling. Too, both projectile impelling and rock drilling may be performed concurrently.

Figure 1:
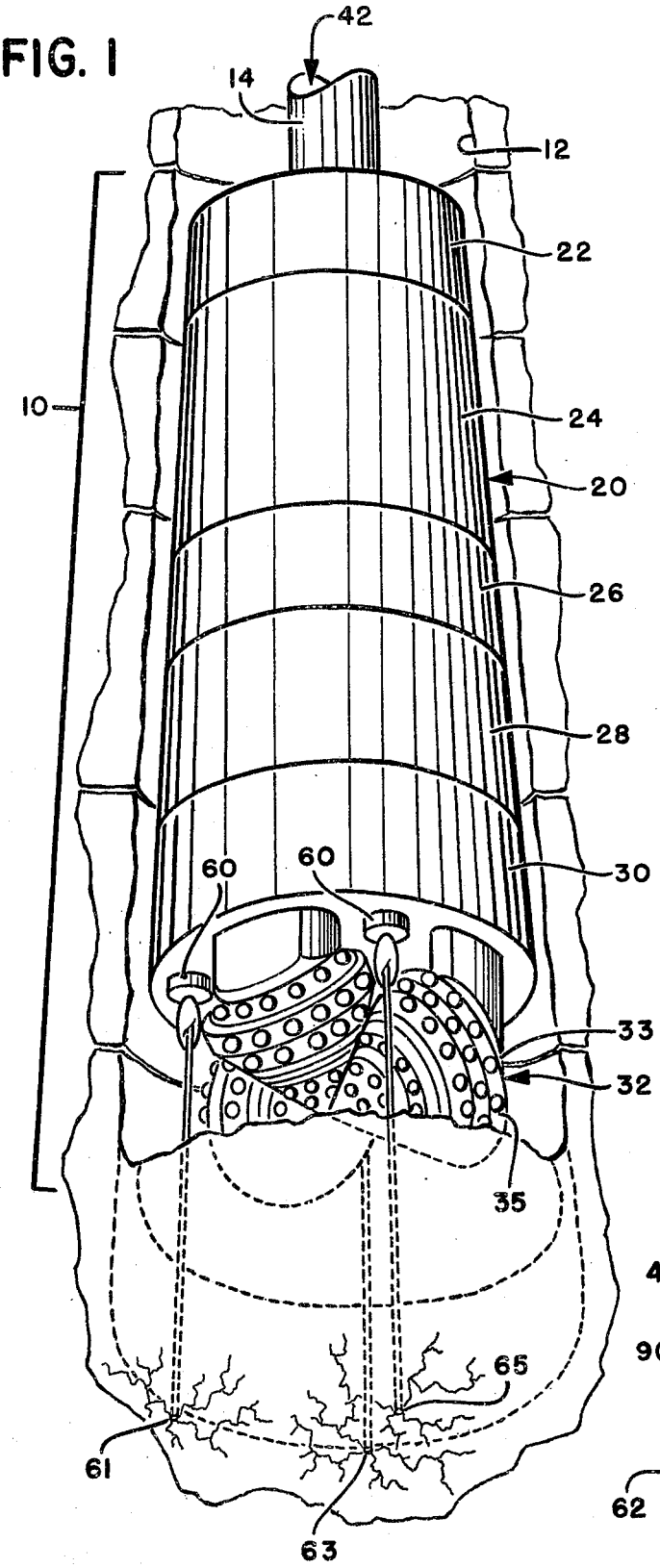
FIG. 1 is a perspective view of a preferred embodiment of the invention.
Figure 3C:
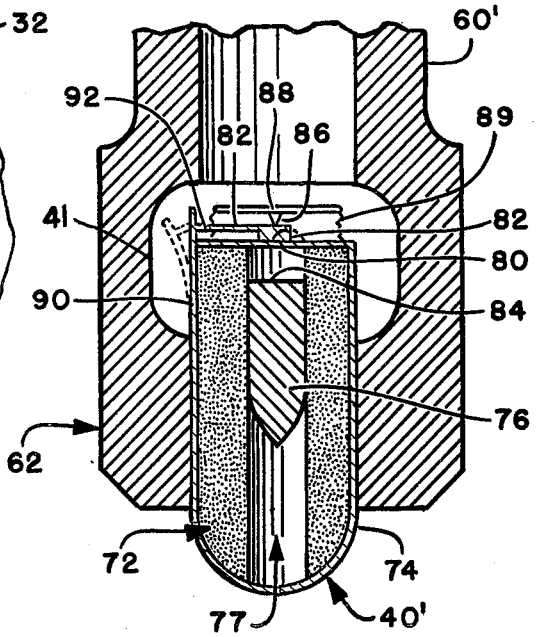
FIG. 3*c* shows another exemplary embodiment of a projectile suitable for use in practicing the invention.
Figure 2:
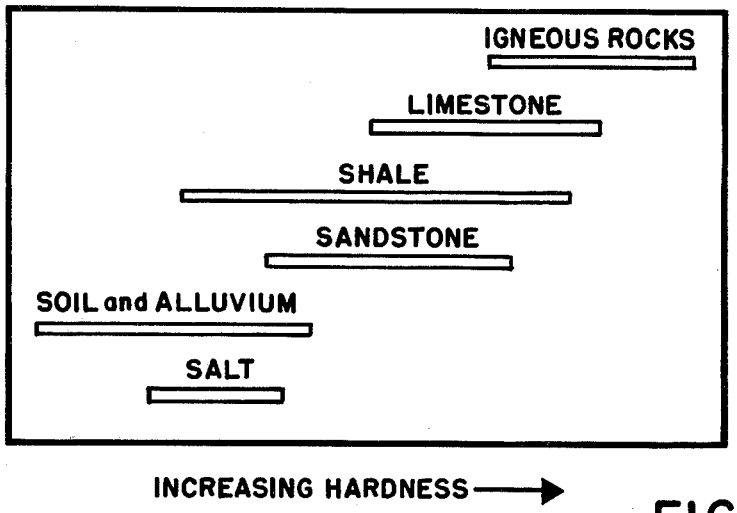
FIG. 2 graphically illustrates the comparative hardness of several types of rocks.
Figure 3A:
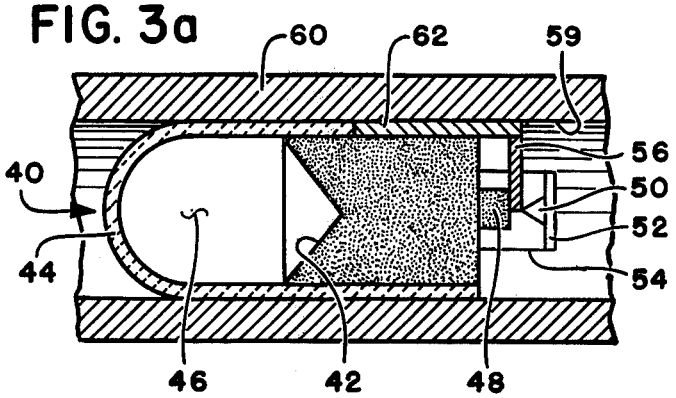
FIG. 3*a* is a partially cutaway view of an exemplary embodiment of a shaped charge projectile in accordance with the invention.
Figure 3B:
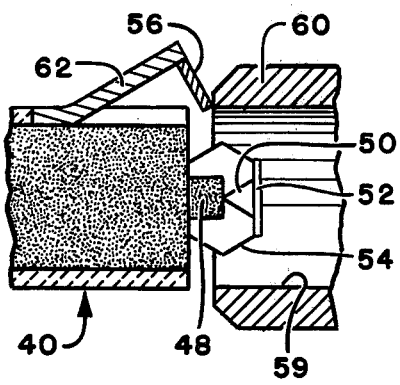
FIG. 3*b* illustrates the rear portion of the projectile of FIG. 3*a* as the projectile is deployed and activated.

In FIG. 1, an apparatus 10 in accordance with the invention may be employed for drilling through hard rock formations within a borehole having wall 12. Apparatus 10 may be rotated on a drill "string" or stem 14 in order to better accomplish rock grinding, fracturing or hole sizing with a bit 32. Drill stem 14 connects at its end above apparatus 10 to well known drilling machinery (not shown) which rotates the drill stem 14 and therewith apparatus 10. Stem 14 may be a hollow or tubular stem as is commonly used in drilling to permit drilling fluid to be injected downwardly therethrough into the bottom of the borehole to clean the rock drill bit 32 as well as to remove fragmented earth material, the projectiles and their fragments.

Rock bit 32 may have any number of appropriately configured cutters, knobs, or protrusions such as the conically shaped or configured cutter 33 disposed on a plurality of conically shaped surfaces 35 which may be positioned about 120° apart as shown in FIG. 1. Naturally, in practicing the invention, bits of different designs may be employed, including percussion bits, rotary bits, roller bits, ring bits, spade and drag bits.

It will be apparent to those of ordinary skill in the art that apparatus 10 may be used in both direct drilling and liquid drilling. The latter makes use of drilling "muds" wherein water or other fluid is used. Densifiers are frequently added to the water or other fluid to provide additional stability to the groundwork, thereby preventing the hole walls from collapsing. They also add material to seal borehole walls, lower fluid viscosity, and expedite in rock debris removal.

Apparatus 10 has a passageway through a center portion thereof in alignment with the inner walls 42 of hollow drill stem 14. Drilling fluid is forced through hollow stem 14 and the passageway in element 10 over the bit 32. Fluid containing drilling refuse is forced from the bottom of the borehole up through the annular space between the exterior surface of apparatus 10 and borehole wall 12. Above apparatus 10, the refuse containing fluid flows upward between the exterior surface of drill stem 14 and the borehole wall 12.

Apparatus 10 preferably comprises a plurality of connected sections forming a generally cylindrical body member 20. One of the sections may be an accelerator energy or weight such as deadweight collar 22 which will provide the force necessary upon the drill bit 32 to effect fracturing, shearing, and the like of the rock under the point loads of the bit's protrusions. A projectile magazine 24 for storing the projectiles, projectile loading mechanism 26, projectile accelerating member 28, and rock bit driving section 30 are all portions of member 20.

In the projectile discharging or impelling operation to be described hereinbelow, a suitable number of projectiles are stored in projectile magazine 24 aboveground prior to the apparatus being lowered into the borehole. Projectiles from magazine 24 are transferred to loading mechanism 26 for subsequent loading into a suitable projectile receiving chamber in the projectile accelerating member 28. The projectiles are then fired through barrels 60 mounted in section 30.

Since stresses in rock formations create drilling problems which are typically most severe in areas adjacent the periphery of the borehole, it may be desirable to impel projectiles into rock such as that in the vicinity of points 61, 63 and 65 adjacent the periphery of the hole illustrated in FIG. 1, but accelerated rates of drilling with reduced rock drill bit wear are also achieved if projectiles are fired into other areas of the borehole. It will be appreciated by those skilled in the art that although FIG. 1 shows projectile barrels 60 spaced between the conically shaped surfaces 35 of drill bit 32, the number and locations of the barrels will be affected by the placement and number of such conical surfaces as well as other drill bit geometry.

It will be noted that the projectiles of FIGS. *3a* and *3c* are of two different types suitable for use in practicing the invention. The particular projectiles employed may comprise a variety of materials such as metal, drilling mud, or ceramics such as alumina. Any material which can penetrate rock and which will not damage or adversely effect the operation of drill bits may also be used. Because of the potential damage to drill bits, projectiles that easily comminute are preferred. Thus, one may use drilling mud projectiles to eliminate the introduction of solid objects into the drilling area.

FIGS. *3a* and *3b* shows a shaped charge projectile 40 within barrel 60 and in firing position, when just released from the barrel. The projectile 40 as seen in FIG. *3a* comprises a jet from a shaped explosive charge 42 using the Monroe jet effect known in the shaped charge explosive art. In FIG. *3a*, shaped charge 42 is disposed in a frangible hermetic container 44 having an air chamber 46 for jet information. The jet will be transmitted to the air in chamber 46, penerating the container 44 and the rock to be fractured.

An exemplary firing or detonation system for any projectile used in practicing the invention may be that illustrated in FIGS. *3a* and *3b*. Affixed to the rear of powder charge 42 is a primer 48. A firing pin 50 mounted on a backing plate 52 is also attached to the rear of charge 42 by a bellows 54. While in the magazine, the barrel, and the loading mechanism, the firing pin 50 is kept from contacting primer 48 by a tab 56 attached at approximately a right angle to an outwardly biased leaf spring 62 which, except for firing, maintains contact with charge 42 by pressure on the leaf spring from the inner surface 59 of the barrel 60, magazine, loading mechanism or other container having similar or the same inner tubular dimensions as barrel 60. FIG. *3b* shows projectile 40 leaving the barrel 60. Outwardly biased spring 62 withdraws tab 56 from its position separating primer 48 and firing pin 50 to allow firing pin 50 to contact and thereby fire primer 48 which ignites the charge 42. The bellows 52 are sufficiently flexible that mud pressure from within barrel 60 exerts sufficient force to accomplish the firing of primer 48.

FIG. *3c* illustrates a different type of cartridge 40' shown to be in a different type barrel 60' having a firing chamber 41 at its cartridge exit end 62. In cartridge 40', which comprises a frangible hermetic container 74 similar to container 44 of Cartridge 40, a passageway or chamber 77 extends axially through a propellent 72 to act as a barrel for accelerating an inner projectile 76 to maximum velocity. On a rear wall 80 of the cartride 40', attaches a primer 82 detonatable by contact with a firing pin 86 mounted on a rear surface 88 of a bellows 89. An outwardly biased leaf spring 90 having a tab 92 extending from the free end thereof separates the firing pin from the primer. In barrel end 62, leaf spring 90 releases as the rear portion of cartridge 40' passes through chamber 41. The mud pressure at the rear wall 88 of cartridge 40' has sufficient force to fire the primer with the firing pin. Naturally, cartridge 40 may be used in barrel 60' and cartridge 40' may be used in barrel 60.

While an impact type detonation device is illustrated, the cartridge charge may be electrially detonated, such as by an electrical bridgewire using a battery to provide the electrical current. This of course can be accomplished by or in the presense of drilling mud by adding electrical contacts to the projectile and by discharging electrical energy to ignite the projectile impelling explosive.

Figure 5:
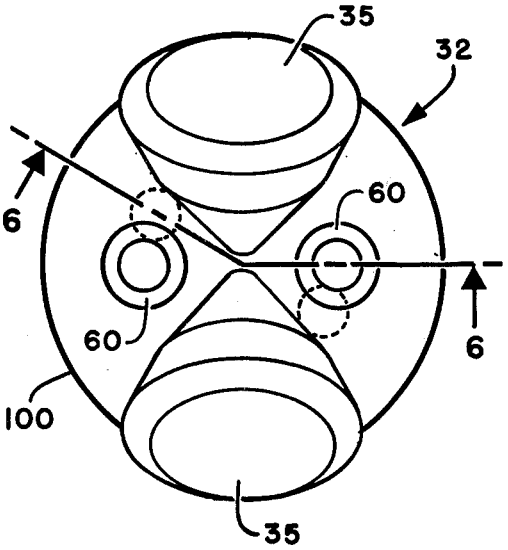
FIG. 5 is a bottom end plan view partially drawn in phantom showing barrel placement in a two rotation cutter, two-barrel embodiment of the invention.

FIG. 5 shows a bottom end plan view of bit 32', having two rollers 35 and two barrels 60. This configuration will be used to further explain the invention.

Figures 6, 6A, 6B:
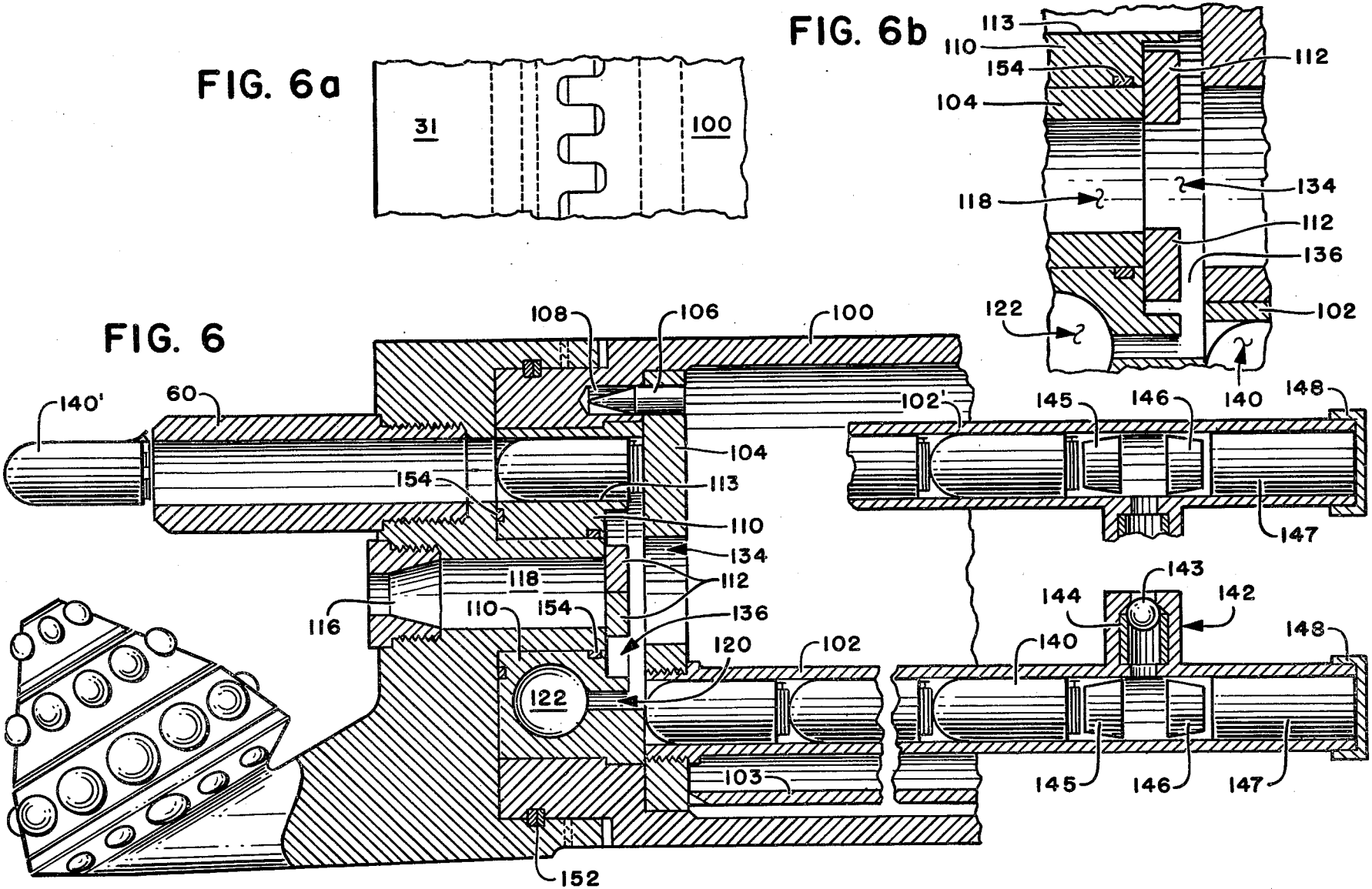
FIG. 6 is a partially cross-sectional and partially elevation cutaway view along lines 6—6 of FIG. 5.
FIG. 6*a* shows the joint between bit body 31 and structural member 100.
FIG. 6*b* shows the mud gates in open position.

FIG. 6 is a partially cross-sectional and partially elevation cutaway view along lines 6—6 of FIG. 5. A structural casing 100, corresponding to the magazine casing 24 of FIG. 1, surrounds magazines 102 and 102' which carry cartridges 140. During drilling mud normally fills the internal area of the magazines, which are affixed to a magazine base 104 by threading and/or welding. Magazine base 104 is preferably aligned with structural casing 100 by means such as guide pins 106 and orifices 108. Because of the lines 6—6 view, only one guide pin-orifice combination is illustrated. A magazine frame 103 adds further structual support to the magazine assembly. Contiguous to magazine base 104 is a loading mechanism revolver 110 having mud gates 112 mounted thereon on pins 114 best seen in FIGS. 9 and 10. Barrels 60 mount in a drill bit body 31 by threading and/or welding. Centered in bit body 31 are a mud jet 116 and an orifice 118.

Figure 7:
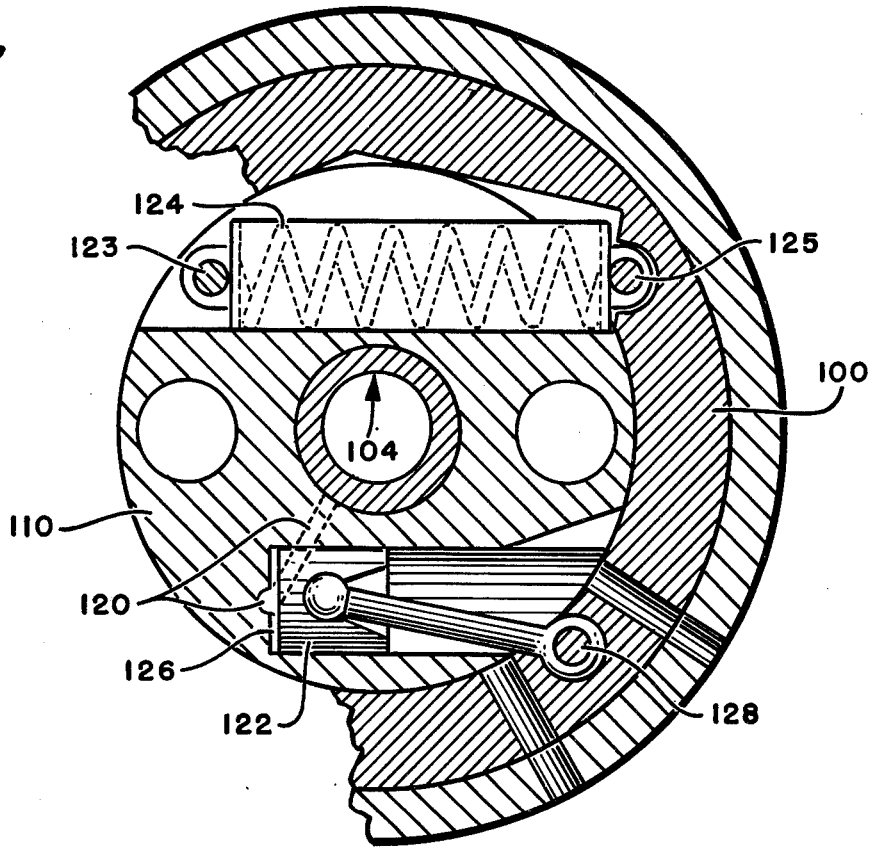
FIG. 7 is a partially cross-sectional and partially elevation view of the revolver along lines 7—7 of FIG. 6.
Figure 8:
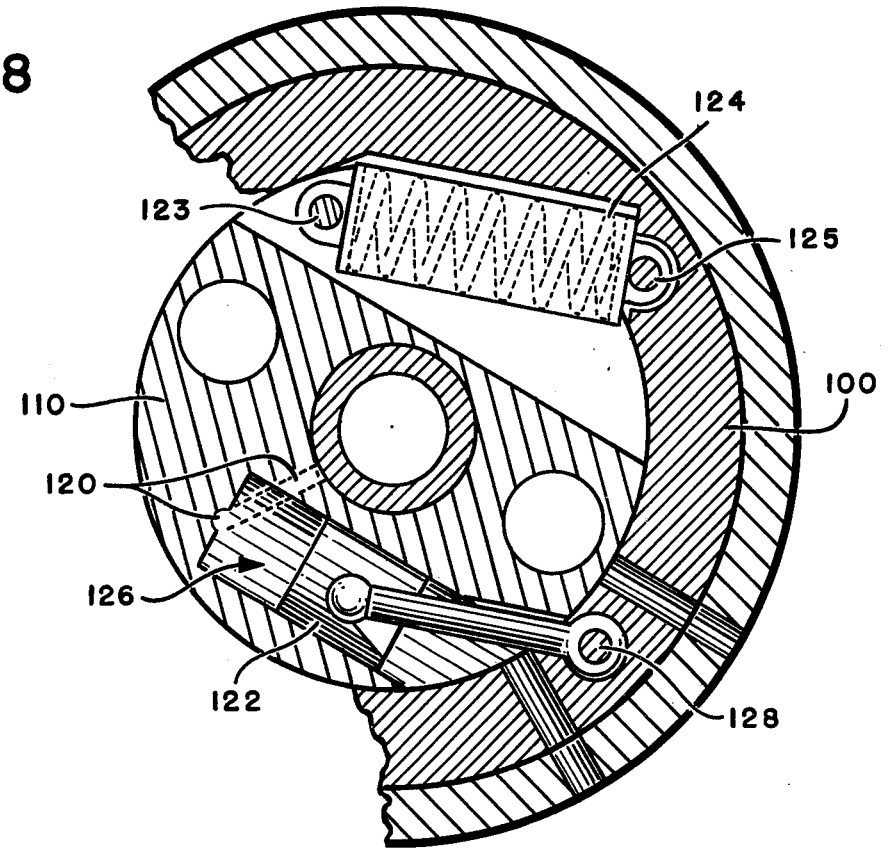
FIG. 8 illustrates the revolver of FIG. 7 in position to receive projectiles from the magazines.
Figure 9:
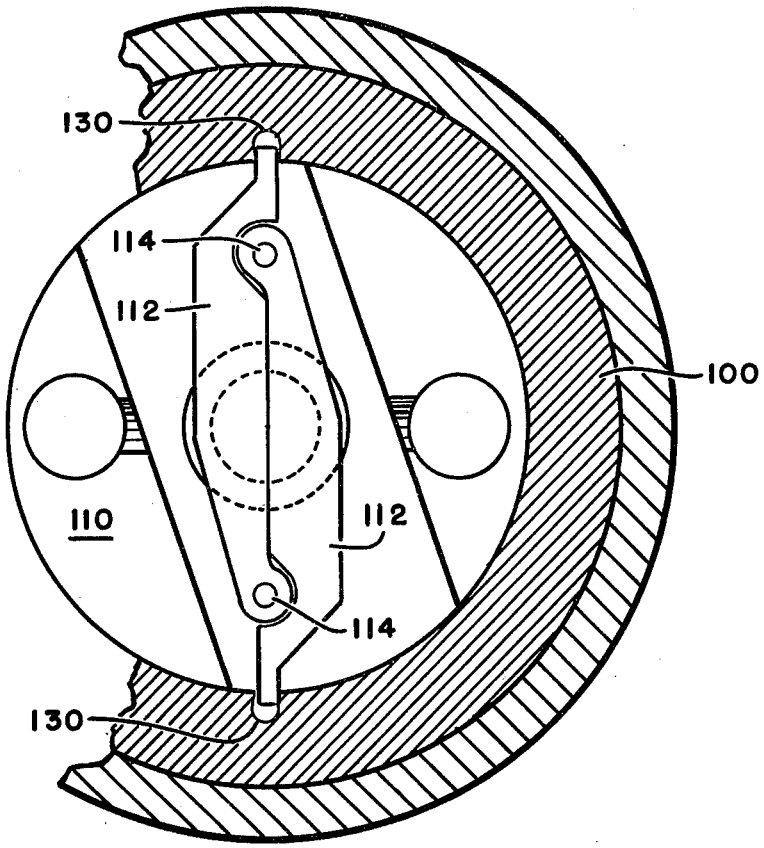
FIG. 9 is a partially plan and partially cross-sectional view of the revolver's gate closing mechanism in closed position along lines 9—9 of FIG. 6.
Figure 10:
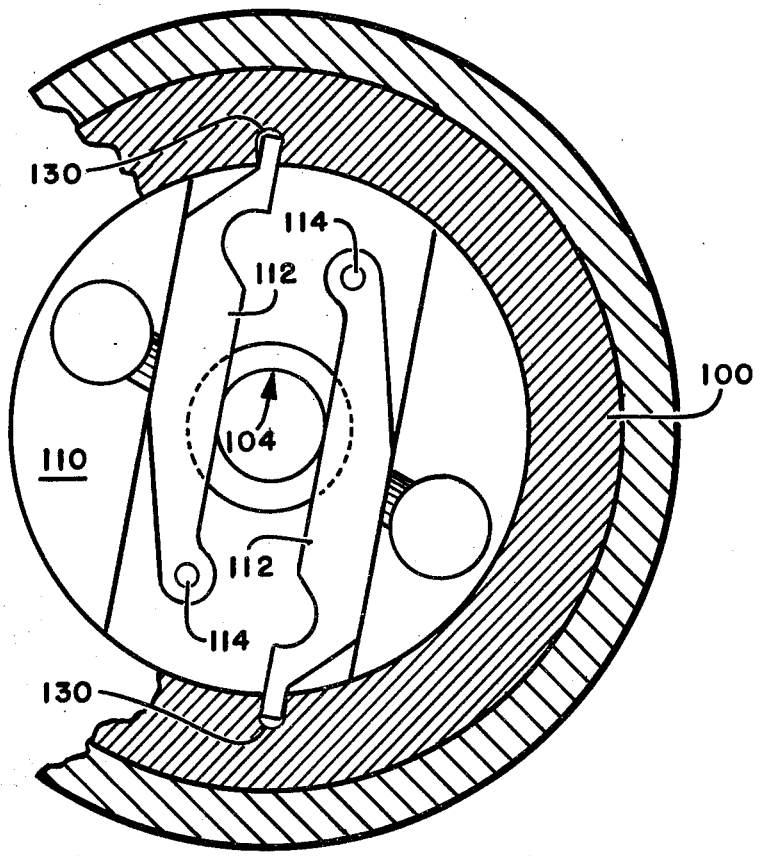
FIG. 10 illustrates the revolver's gate closing mechanism of FIG. 9 in the open position.

Revolver 110 action is best illustrated in FIGS. 7 through 10. As shown therein, revolver 110 turns relative to structural member 100 when mud enters passageway 120 to force revolver 110 to turn relative to piston assembly 122 mounted on a pin 128 on member 100, compressing a return spring 124 rotataby affixed at one end to pin 123 on revolver 110 and at the other to pin 125 on member 100. FIG. 7 shows piston assembly 122 held at the top of its stroke in chamber 126 of revolver 110 when there is no mud pressure by the extension force of spring 124. Under mud pressure as seen in FIG. 8, the chamber 126 fills with mud from passageway 120 to revolve revolver 110 relative to structural member 100. The FIG. 9 position of revolver 110 showing closed mud gates 112 corresponds to the FIG. 7 position whereas the FIG. 10 position of mud gates 112 open under mud pressure corresponds to that of FIG. 8. As shown in FIGS. 9 and 10, mud gates 112 pivot about mud gate pins 114 on revolver 110, levered thereon by the containment of their ends within U shaped notches 130 in structural member 100 when revolver 110 turns relative to member 100.

O-rings 154 act to seal the revolver's sliding surfaces relative to those of bit body 31, sealing in lubricants and denying entry thereto of mud.

In the operation of the embodiment shown in FIGS. 5–10, magazines 102 and 102' both load and fire cartridges simultaneously. Magazine 102' chambers its cartridge into the revolver in the same way as magazine 102. With the mud gates 112 closed as shown in FIGS. 6, 7 and 9, mud flows to the rear of a chambered cartridge 140 through a circular orifice 134 in magazine base 104 and a flow path 136 in revolver 110. Mud flowed around the bellows of cartridge 140 during its chambering in barrel 60 by revolver 110. Mud pressure forces the barrel-chambered cartridge down through the gun barrel 60 into the firing position shown by cartridge 140' at the end of barrel 60, where the outwardly biased safing spring moves away from the cartridge and allows the firing pin to contact and thereby fire the primer and the charge within the cartridge. With gates 112 closed, mud also passes through passageway 136 into and through passageway 120 into piston chamber 126, causing the piston assembly 122 to revolver 110 relative to structural member 100. This causes gates 112 to open into the position shown in FIGS. 6*b*, 8 and 10. When revolver 110 is fully rotated by piston assembly 122, gates 112 achieve their fully open position.

Mud under pressure also flows through a check valve in each magazine such as a ball check valve 142 having a ball 143 and a seat 144 to force the cartridges therein downwardly through the magazine by acting against boots 145 and 146. It will be noted that as mud flows into the magazine, boot 146 compresses a spring 147 against a magazine butt plate 148. When mud pressure stops, check valve 142 closes, but the spring 147 retains pressure on mud within the magazine to maintain the cartridges therein pressed against revolver 110.

Cartridges chamber in revolver 110 only when the mud gates close, moving into alignment with the barrels by revolver rotation, occuring as the gates close. After the cartridges chamber in barrels 60, mud flows pushes them through and out the ends of the barrels. When mud flow is interrupted, manually or automatically, from a position on the rig or elsewhere, compressed return spring 124 on revolver 110 extends to rotate revolver 110 relative to piston assembly 122 and member 100 to close mud gates 112 and to position the chambers in revolver 110 again into alignment with magazines 102 and 102'. The springs 147 within the magazines, via mud pressure, chamber the cartridges pressed against revolver 110 into chambers therein. As mud pressure returns, revolver 110 rotates the cartridge chambered therein into axial alignment with the barrels 60, mud flow pressure holding the gates 112 open by piston assembly 112 — revolver 110 interaction. Mud flow pressure then chambers the cartridges in the barrels, moves them through the barrels and fires them. When the mud flow again stops, mud pressure ceases and return spring 124 revolves revolver 110 to close the gates and again chamber revolver-chambered cartridges into alignment with barrels 60. Thus, intermittent mud pressure application controls cartridge chambering and firing.

When mud flows through open gates 112 it cannot simultaneously flow through barrels 60 because passageway 136 thereto is closed. The tubular magazines do not remove relative to the barrels because the magazine assembly does not rotate relative to bit body 31. Rotator 110 does all the rotating.

The magazines 102 and 102' are pressurized through their respective check valves when the mud is pressurized so that the chambering and firing of the projectiles is controlled by either manual or automatic intermittent mud pressure interruption. When the mud gates 112 open, mud also passes through orifice 118 and mud jet 116 to lubricate the working parts of the bit and to clear the drilling area of debris.

Bit body 31 attaches to structural member 100 with conventional wedge tape 152 as best seen in FIG. 6*a* which shows the structural member 100 and bit body 31 taped together using a well known torsion lock tape joint.

Figure 4:
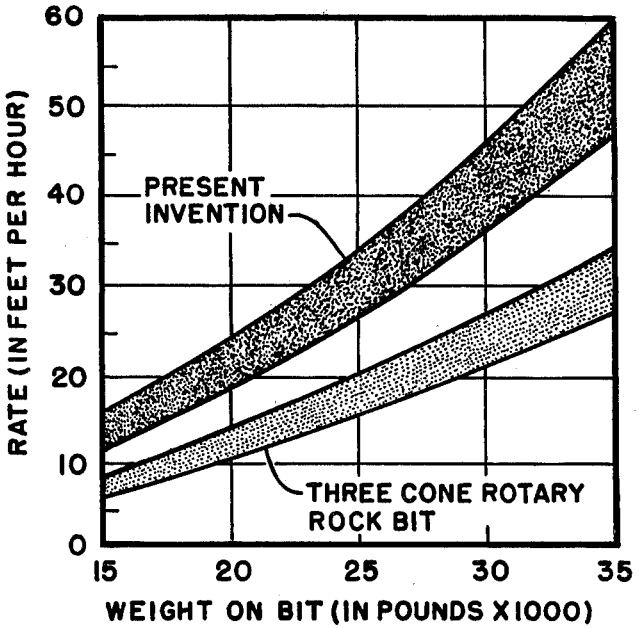
FIG. 4 graphically compares drilling rates practicing the invention with prior art rock bit drilling rates.

FIG. 4 shows how drilling rates were being increased using the present invention on a three cone rotary rock bit drilling through madera limestone rock.

It will be appreciated that more than one or two projectile barrels may be employed and that their placement will depend upon drill bit geometry. There may be simultaneous firings as illustrated in the preferred embodiment or separate firings from a plurality of barrels in any selected sequence. Mud pressure interruption for cartridge firing control may be by a suitable mechanical hook-up which translates the mud pumping "start" and "stop"pressure sisnals to a fire or activation signals.

The various features and advantages of the invention are thought to be clear from the foregoing description. However, various other features and advantages not specifically enumerated will undoubtedly occur to those versed in the art, as likewise will many variations and modifications of the embodiments illustrated herein, all of which may be achieved without departing from the spirit and scope of the invention as defined by the appended claims.

We claim:

1. In a drilling apparatus utilizing drilling mud under pressure and comprising drill string and drill bit, and improvement comprising:

at least one barrel from which projectiles may be impelled;

at least one magazine for containing a plurality of said projectiles;

means responsive to drilling mud pressure for moving a projectile from said magazine into, through, and out of said barrel; and means integral with said projectile for firing said projectile upon its exit from said barrel to impel said projectile into rock to be drilled.

2. An apparatus comprising:

drill string;

drill bit; and projectile firing means for fracturing rock in the path of the drill bit, said projectile firing means comprising a barrel, tubular magazine means for storing projectiles, and revolvable means for receiving projectiles from said magazine means and for positioning them for chambering into said barrel.

3. The invention of claim 2 further comprising means for controlling said projectile firing means with mud pressure.

4. The invention of claim 3 wherein said revolvable means comprises mud gates which when closed direct mud flow to force a projectile through and out of said barrel.

5. The invention of claim 4 wherein said gates, when open, direct mud over the drill bit to lubricate it and to remove drilling debris from the vicinity thereof.

6. The invention of claim 5 wherein said revolvable means further comprises a piston assembly and means for biasing said piston assembly at the top of its stroke, said piston assembly comprising a chamber open to mud flow such that mud flow thereinto forces said piston assembly to the bottom of its stroke to revolve said rotatable means to open said mud gates.

* * * * *